United States Patent [19]

Solano et al.

[11] Patent Number: 4,741,693

[45] Date of Patent: May 3, 1988

[54] METHOD AND APPARATUS FOR CALCINING MATERIAL CONTAINING VOLATILE CONSTITUENTS

[75] Inventors: William E. Solano; James P. Docherty; Joseph W. Stubenbort, all of Pittsburgh, Pa.

[73] Assignee: Salem Furnace Co., Pittsburgh, Pa.

[21] Appl. No.: 52,077

[22] Filed: May 21, 1987

Related U.S. Application Data

[60] Continuation of Ser. No. 895,712, Aug. 12, 1986, abandoned, which is a division of Ser. No. 797,150, Nov. 12, 1985, Pat. No. 4,637,795.

[51] Int. Cl.[4] ..... F27D 13/00

[52] U.S. Cl. ..... 432/5; 432/11; 432/124; 432/139

[58] Field of Search ..... 432/124, 139, 5, 11, 432/12

[56] References Cited

U.S. PATENT DOCUMENTS

| | | | |
|---|---|---|---|
| 319,180 | 6/1885 | Bietrix . | |
| 2,530,651 | 11/1950 | Christensen | 263/21 |
| 3,448,012 | 6/1969 | Allred | 201/27 |
| 3,470,068 | 9/1969 | Kemmerer | 201/33 |
| 3,652,426 | 3/1972 | Oleszko | 202/216 |
| 3,740,184 | 6/1973 | Oleszko | 432/235 |
| 3,998,703 | 12/1976 | Harrell | 201/32 |
| 4,149,939 | 4/1979 | Solano | 201/27 |

FOREIGN PATENT DOCUMENTS 826683 1/1960 United Kingdom .

*Primary Examiner*—Henry C. Yuen

*Attorney, Agent, or Firm*—Buell, Ziesenheim, Beck & Alstadt

[57] ABSTRACT

Bulk materials containing volatile constituents are calcined in a two-stage process comprising a first heating stage at de-volatilizing temperature but below calcining temperature during which the material is turned over and mixed to accelerate its bulk heating rate without substantially accelerating local heating rate. The first heating stage is followed by a second heating stage at calcining temperature. A rotary hearth furnace adapted for the above process is divided into outer and inner connecting annular heating zones and has rabble means for turning over and mixing the charge in the outer zone and rabble means for transporting the charge through both zones.

1 Claim, 2 Drawing Sheets

23
20
21
19
25
25
17
17
16
16
24
24
18
18
26
26
10
11
13
15
14
22

IV
11
10
13
26
12b
12a
IV

METHOD AND APPARATUS FOR CALCINING MATERIAL CONTAINING VOLATILE CONSTITUENTS

This application is a continuation of application Ser. No. 895,712, filed Aug. 12, 1986, now abandoned, which is a division of application Ser. No. 797,150 filed Nov. 12, 1985 now U.S. Pat. No. 4,637,795.

This invention relates to methods of calcining particulate bulk materials containing volatile constituents and to a rotary hearth furnace for such material. It is more particularly concerned with a two-stage heating process and a rotary furnace adapted for that two-stage heating.

BACKGROUND OF THE INVENTION

Particulate materials such as non-caking coals, green petroleum coke, anthracite coal, bituminous coal, wood products and other carbonaceous materials, dolomite, limestone and the like must often be de-volatilized and calcined for further use. Rotary hearth furnaces are commonly used for that purpose. The raw material is charged upon the hearth at its circumference and rabbles fixed in the stationary roof cause the material to move toward the center of the hearth, through which it is discharged as the hearth rotates. Heat is generated in the furnace chamber sufficient to raise the material to a calcining furnace temperature which in the case of petroleum coke the like materials is between about 1250 degrees C. and 1500 degrees C. As the coke or other material travels toward the center of the hearth, it rapidly heats up and its volatile constituents are driven off. The material so calcined however is physically weak and fragments easily. For some purposes that characteristic is undesirable. In the manufacture of electric furnace electrodes from petroleum coke for example it has been found that the easily fragmented coke produces electrodes relatively low in mechanical strength.

SUMMARY OF THE INVENTION

We have found that coke and like calcined materials of considerably improved physical strength can be produced in a rotary hearth furnace by a two-stage process comprising heating the particulate material containing volatile constituents at temperatures in the volatilizing range at a relatively slow rate and then relatively rapidly heating the devolatilized material at temperatures in the calcining range. We prefer to carry out that process by causing the material to travel through separate zones of a single furnace, the first zone being held at a temperature not exceeding the temperature at which de-volatilizing is substantially completed but below the calcining temperature and the second zone being held at such calcining temperature. The de-volatilizing furnace temperature range for petroleum coke is between about 480 degrees C. and about 725 degrees C. and the calcining temperature is between about 1250 degrees C. and 1500 degrees C. as has been mentioned. Those ranges vary for other particulate materials. We have found that in a reverberatory furnace the surface layer of the charge is heated by radiant heat at a much faster rate than the bulk rate of heating of the entire charge and we mix or turn over the charge in the pre-heating or de-volatilizing zone to reduce the difference between those rates.

We prefer to carry out our process above-described in a rotary hearth furnace having a stationary roof which is much closer to the hearth in an outer annular zone where pre-heating takes place than in an inner zone where calcining takes place and which has rabbles in its outer zone which turn over and mix the charge. Both zones are provided with transport rabbles which move the charge toward the center of the hearth, and with separate fuel burners.

DESCRIPTION OF PREFERRED EMBODIMENTS

By way of example our preferred embodiment will be described as adapted for the calcining of green petroleum coke but our invention is not limited to that specific particulate material.

Figure 1:
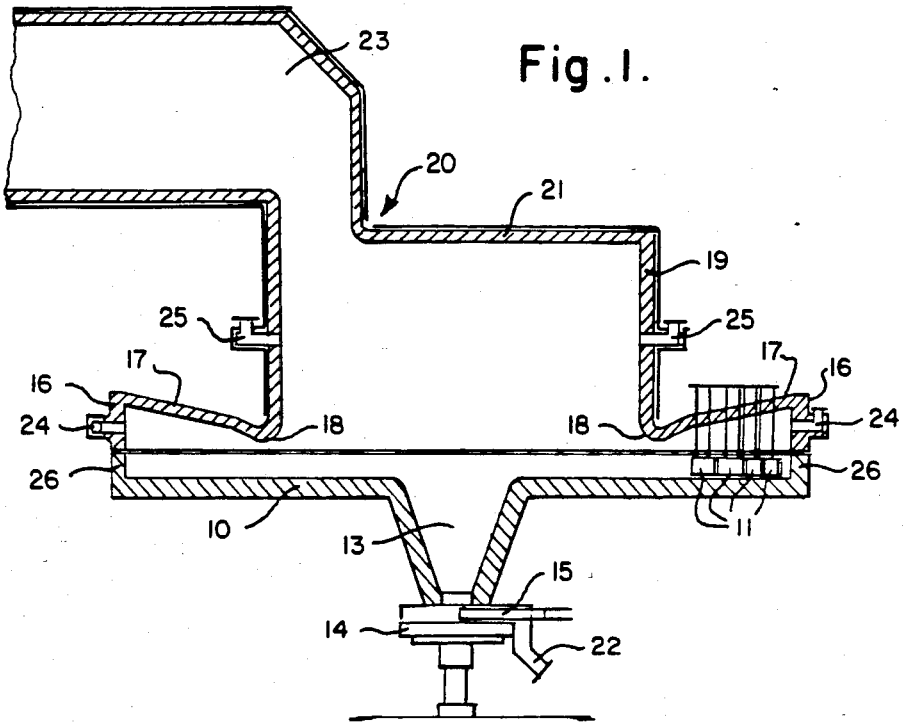
FIG. 1 is a vertical diagrammatic section of a furnace of our invention.
Figure 4:
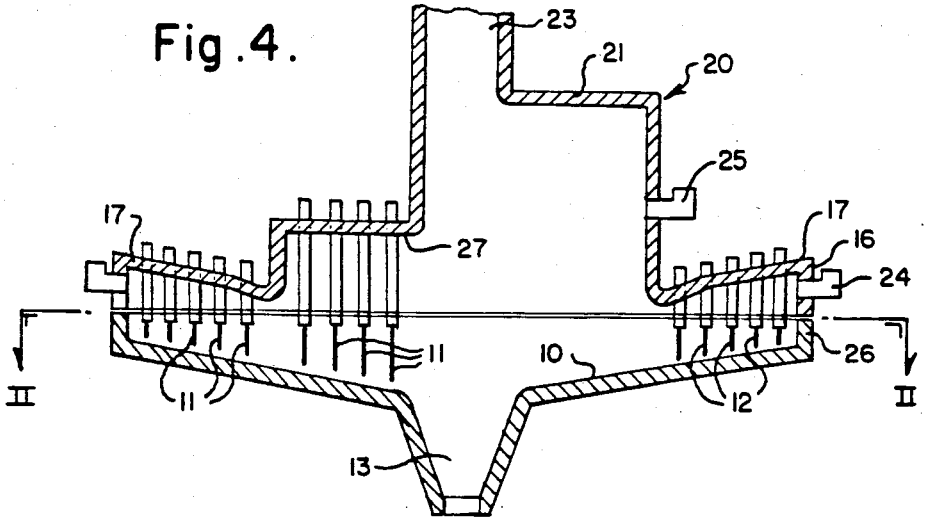
FIG. 4 is a vertical diagrammatic section of another embodiment of our furnace taken on the plane IV—IV of FIG. 2.

Typical rotary hearth furnaces of the prior art are disclosed in Kemmerer, Jr., et al. U.S. Pat. No. 3,470,068 and Oleszko, U.S. Pat. No. 3,652,426. The furnace of our invention comprises a rotary hearth 10 which may be level as is shown in FIG. 1 or may slope toward its center as shown in FIG. 4. At its center the hearth opens into a soaking pit 13 which discharges onto a rotary discharge table 14 from which a plow 15 pushes the calcined material into a discharge chute 22. The rotary discharge table may be concentric with soaking pit 13 or may be offset therefrom. Hearth 10 is surrounded by a circumferential wall 26. The stationary furnace roof 20 comprises a circumferential outer wall 16 which is sealed to rotating wall 26 by conventional means not shown, an annular roof portion 17 which slopes downwardly and inwardly from the upper edge of outer wall 16 to an annular nose or ring 18 intermediate wall 26 and soaking pit 13. From nose 18 the roof rises as an upright cylindrical portion 19 to a flat top 21 opening into a flue 23. Fuel burners 24 are set around wall 16 and fuel burners 25 are set around wall 19.

Figure 2:
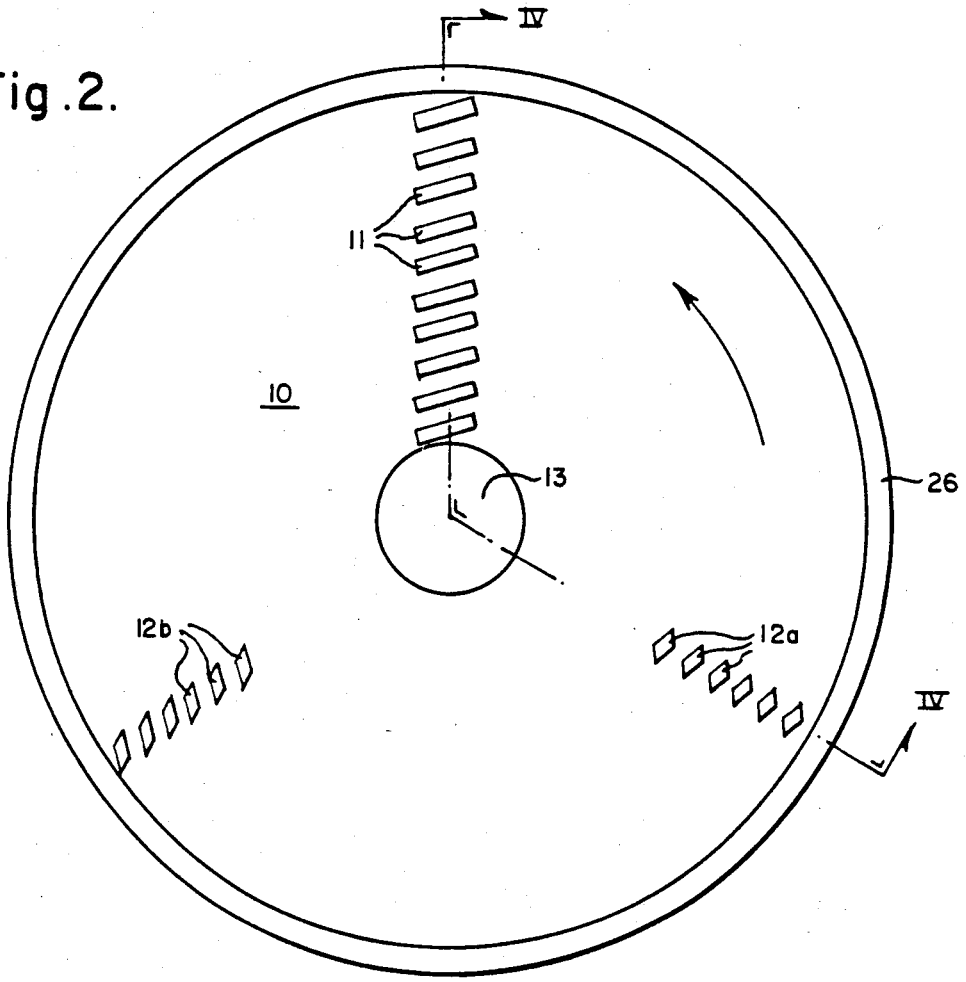
FIG. 2 is a horizontal section taken on the plane II—II of FIG. 4.

Conventional transport rabbles 11 are mounted in roof portions 17 and 27 and similar rabbles 12, which we designate as mixing rabbles, are mounted in roof portion 17 in at least one pair of arrays designated **12*a* and 12*b* in FIG. 2. Each of those arrays is in a different vertical plane from that of transport rabbles 11. The individual mixing rabbles in their mixing action also transport the charge and the rabbles in arrays 12*a* and 12*b* are adjusted so that their transport components are in opposite directions, thus cancelling them. In this way the mixing and the transporting of the charge in our preheating zone can be separately controlled by adjustment of their respective rabbles. The transport rabbles in roof 21** are mounted in conventional rabble pit as is shown in the Oleszko patent above-mentioned.

Figure 3:
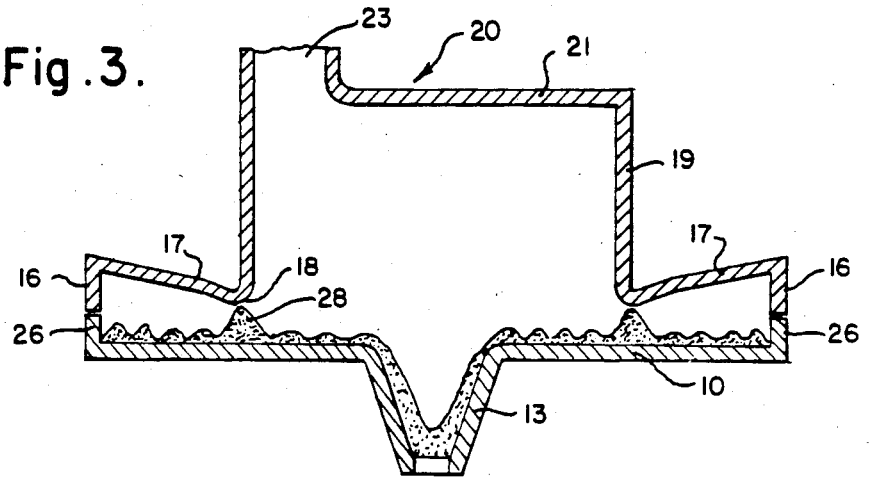
FIG. 3 is a vertical section showing a portion of the furnace of FIG. 1 with a charge on its hearth.

The transport rabbles 11 are of conventional configuration and are arranged so that if one of them is removed the charge on the hearth builds to a higher elevation to form a barrier ring 28 as shown in FIG. 3. Such a barrier may generally correspond to the interface between the two zones in the furnace to be described hereinafter. Mixing rabbles 12 are essentially of the same configuration as transport rabbles 11 but are positioned in paired arrays as has been mentioned. If mixing rabbles 12 are replaced by plows which turn over the charge without effectively transporting it they may be positioned in a single array.

Our process is carried out in our furnace above-described by charging the material to be calcined onto the hearth 10 at its circumference at one or more stations, not shown. Fuel is burned in burners 24 and heat therefrom is reflected by inclined roof portions 17 upon the charge. Petroleum coke and like materials exposed to such radiation heats rapidly at its surface but very slowly therebeneath. Mixing rabbles 12 are positioned so that their working ends are in the charge bed and turn it over to expose fresh surfaces to the radiant heat. Transport rabbles 11 move the charge bed toward the soaking pit 13 in the conventional way. The temperature within the preheat zone, which is roughly that zone under roof portion 17, is maintained within a range sufficient to drive off the volatile constituents of the charge but below its calcining temperature. The preheat furnace temperature range for green petroleum coke is between about 480 degrees C. and about 725 degrees C. as has been mentioned. For other charges the preheat temperature would depend on the nature of the volatile constituents to be removed. Some or all of the volatile constituents of a charge may themselves burn and give off heat in which case the heat required from burners 24 is reduced. The pre-heating of the charge and its mixing are preferably adjusted with reference to the travel of the charge toward soaking pit 13 so that the de-volatilization of each segment of the charge is substantially complete when that segment reaches a radiation barrier between the pre-heating and calcining zones. That barrier, as far as it is fixed by the furnace structure, is found at nose 18. However, the charge itself can be caused to mound up as shown at 28 in FIG. 3 below the position of a transport rabble if that rabble is lifted and thus forms a radiation barrier at that location. Considerable flexibility in the operation of our furnace is thus determined in that way.

The portion of the furnace within cylindrical wall 19 forms the calcining zone. Additional heat is supplied to that zone through burners 25 to maintain a calcining temperature therein. The calcining furnace temperature for petroleum coke is between about 1250 degrees C. and about 1500 degrees C. as has been mentioned, the coke temperature will generally be in the range between about 815 degrees C. and about 1650 degrees C.; desirably between about 980 degrees C. and about 1480 degrees C. and most preferably between about 1200 degrees C. and about 1455 degrees C. For calcining coal the coal temperature range is between 370 degrees C. and 1370 degrees C.; desirably between about 650 degrees C. and 1200 degrees C. and most preferably about 980 degrees C. and about 1150 degrees C.

In the foregoing specification we have described presently preferred embodiments of our invention; however it will be understood that our invention may be otherwise embodied within the scope of the following claims.

We claim:

1. The method of calcining a bulk material containing a volatile constituent in a furnace having a stationary circular chamber and roof and a hearth rotating therein with a discharge opening in its center and transport rabbles mounted in said roof extending into said hearth for urging material on said hearth toward said discharge opening when said hearth is rotated, said chamber having means positioned intermediate said discharge opening and said chamber wall so as to divide said chamber into at least an inner and an outer connecting co-axial annular portion, comprising charging said material on said hearth in said outer portion to form a bed traveling toward said discharge opening, applying radiant heat to said material below calcining temperature in said outer portion, and turning over and mixing the charge with said rabbles in said outer portion against the direction of travel of said material, thereby imparting to said material a transport component directed toward said charging opening so as to reduce the difference between its surface heating rate and its bulk heating rate, then heating said material to calcining temperature in said inner portion while mixing said material in the direction of travel, thereby imparting to said material a transport component directed towards said discharge opening, and adjusting said mixing steps so that the transport of said bed through said annular portions is completed when said volatile constituents are driven off and said calcining is completed.

* * * * *